US009311882B2

(12) United States Patent
Jung

(10) Patent No.: US 9,311,882 B2
(45) Date of Patent: Apr. 12, 2016

(54) DISPLAY DEVICE

(71) Applicant: LG DISPLAY CO., LTD., Seoul (KR)

(72) Inventor: Yong-Chae Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 169 days.

(21) Appl. No.: 14/136,450

(22) Filed: Dec. 20, 2013

(65) Prior Publication Data

US 2014/0184483 A1 Jul. 3, 2014

(30) Foreign Application Priority Data

Dec. 31, 2012 (KR) ..... 10-2012-0158110

(51) Int. Cl.
*G09G 3/36* (2006.01)

(52) U.S. Cl.
CPC ..... *G09G 3/3688* (2013.01); *G09G 2310/0291* (2013.01); *G09G 2330/025* (2013.01); *G09G 2330/04* (2013.01)

(58) Field of Classification Search
CPC ..... G09G 3/3688; G09G 2330/025; G09G 2330/04; G09G 2310/0291
USPC ..... 345/87, 211
See application file for complete search history.

(56) References Cited

U.S. PATENT DOCUMENTS

2007/0001978 A1* 1/2007 Cho ..... G09G 3/3655 345/98
2009/0141012 A1* 6/2009 Tomiyoshi ..... G09G 3/3611 345/211
2011/0199397 A1* 8/2011 Ko ..... G09G 3/3688 345/690
2012/0280961 A1* 11/2012 Son ..... G09G 3/3685 345/211

FOREIGN PATENT DOCUMENTS

CN 101297349 B 8/2010
CN 102768827 A 11/2012
KR 10-2010-0097872 9/2010

OTHER PUBLICATIONS

Office Action dated Nov. 3, 2015 for corresponding Chinese Patent Application No. 201310697936.X, 13 pages.

* cited by examiner

*Primary Examiner* — Dwayne Bost
*Assistant Examiner* — Stefan M Oehrlein
(74) *Attorney, Agent, or Firm* — Brinks Gilson & Lione

(57) ABSTRACT

A display device includes a data driver having i data output terminals (i being a natural number greater than 1) and outputting data voltages to the i data output terminals in accordance with a source output enable signal provided from a timing controller, an output controller connected between the i data output terminals and i data lines, and i garbage switches respectively connected to the i data lines and connecting the i data lines to a ground terminal at a power input timing when a power supply voltage is applied to the display device, and interrupting the connection between the i data lines and the ground terminal at a timing later than an output timing of a first source output enable signal provided from the timing controller after the power input timing.

7 Claims, 6 Drawing Sheets

DISPLAY DEVICE

This application claims the benefit of priority to Korean Patent Application No. 10-2012-0158110 filed on Dec. 31, 2012, which is hereby incorporated by reference as if fully set forth herein.

BACKGROUND

1. Field of the Disclosure

The present disclosure relates to a display device, and more particularly, to a display device capable of normally displaying an image by preventing malfunction of a data driver.

2. Discussion of the Related Art

A conventional display device includes a garbage switch for preventing an abnormal signal on a screen at a power input timing. The garbage switch is turned on from the power input timing and is turned off at an output timing of a first source output enable signal.

Unknown data having a random size is latched in a data driver at the power input timing, and is output to a data line via the data driver before the first source output enable signal is output. That is, since the source output enable signal is already in a low state at the power input timing, in response to this, the data driver outputs an unknown data voltage corresponding to the unknown data.

Since the garbage switch is turned off due to the first source output enable signal in the conventional display device, the unknown data voltage is still output to the data line after the first source output enable signal is output, and thus the unknown data voltage may not be completely discharged to a ground level.

If the unknown data voltage has a large value, overcurrent is generated due to a voltage difference from the data line that was in a ground level, and flows into the data driver thus causing malfunction of the data driver. Then, an abnormal image may be displayed on a screen.

SUMMARY

A display device includes a data driver having i data output terminals (i being a natural number greater than 1) and outputting data voltages to the i data output terminals in accordance with a source output enable signal provided from a timing controller, an output controller connected between the i data output terminals and i data lines, and i garbage switches respectively connected to the i data lines and connecting the i data lines to a ground terminal at a power input timing when a power supply voltage is applied to the display device, and interrupting the connection between the i data lines and the ground terminal at a timing later than an output timing of a first source output enable signal provided from the timing controller after the power input timing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
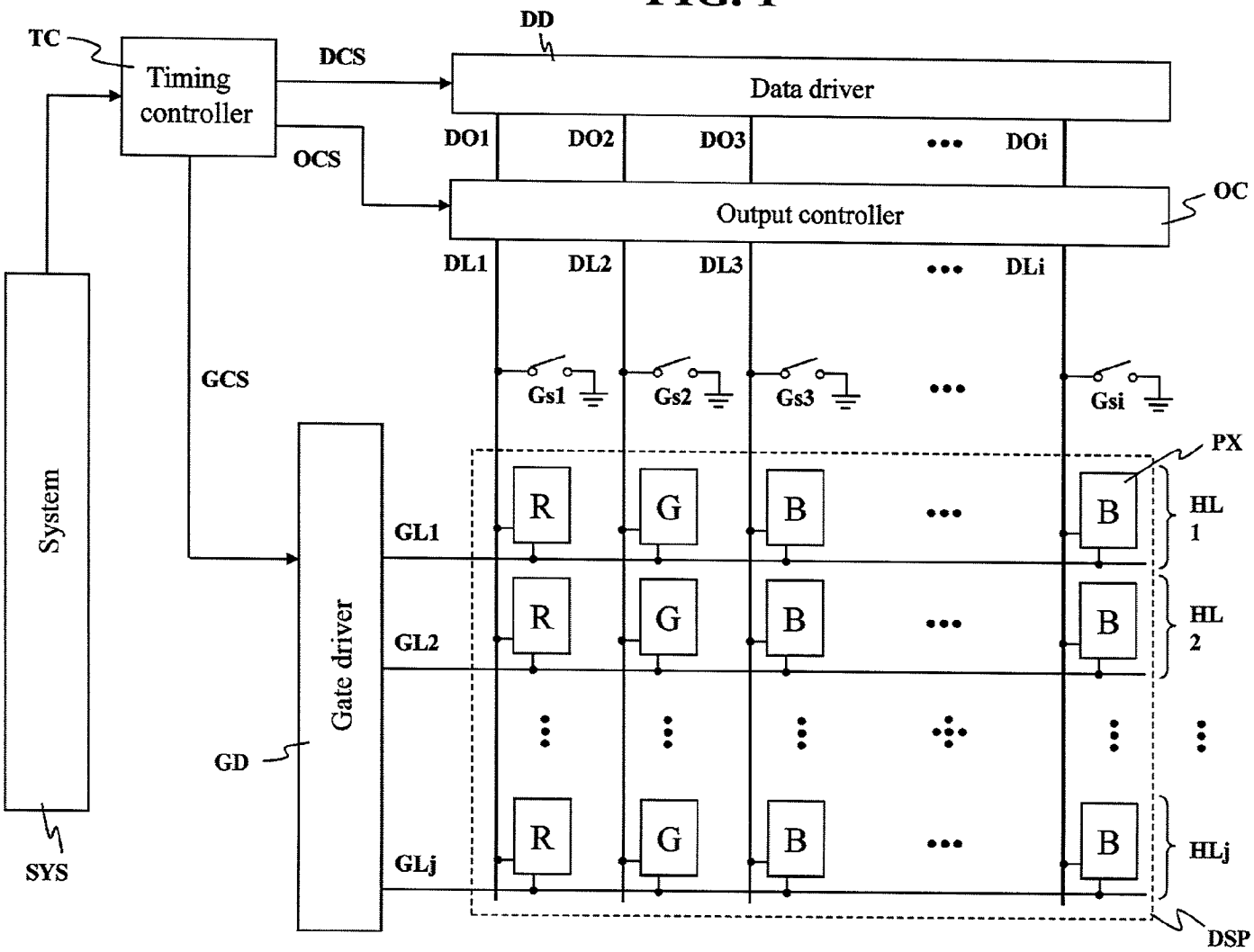
FIG. 1 illustrates a display device according to an embodiment of the present invention.

FIG. 1 illustrates a display device according to an embodiment of the present invention.

As illustrated in FIG. 1, the display device according to the embodiment of the present invention includes a display unit DSP, a system SYS, a timing controller TC, a data driver DD, an output controller OC, a gate driver GD and a plurality of garbage switches, e.g., first to ith garbage switches Gs1 to Gsi (i being a natural number greater than 1).

The display unit DSP includes i×j pixels PX, first to ith data lines DL1 to DLi, and first to jth gate lines GL1 to GLj. Here, first to jth gate signals are respectively applied to the first to jth gate lines GL1 to GLj, and data voltages are respectively applied to the first to ith data lines DL1 to DLi.

The pixels PX are arranged in a matrix on the display unit DSP. The pixels PX are divided into red pixels R for displaying red, green pixels G for displaying green, and blue pixels B for displaying blue. In this case, a red pixel R, a green pixel G, and a blue pixel B disposed adjacent to each other in a horizontal direction correspond to a unit pixel for displaying one unit image. Here, if the display device according to the embodiment of the present invention is a liquid crystal display device, each of the pixels PX may include a thin film transistor, a pixel electrode, a common electrode, liquid crystals, etc.

i pixels arranged along an nth horizontal line (n being one selected among 1 to j) (hereinafter referred to as nth horizontal line pixels) are individually and respectively connected to the first to ith data lines DL1 to DLi. In addition, the nth horizontal line pixels are commonly connected to an nth gate line. As such, the nth horizontal line pixels commonly receive an nth gate signal. That is, i pixels arranged in the same horizontal line commonly receive the same gate signal while pixels arranged in different horizontal lines receive different gate signals. For example, the red, green, and blue pixels R, G, and B located in a first horizontal line HL1 receive the first gate signal while the red, green, and blue pixels R, G, and B located in a second horizontal line HL2 receive the second gate signal having a different timing from the first gate signal.

The above-described first to jth gate signals are pulses having the same form but different output timings.

The system SYS outputs a vertical synchronization signal, a horizontal synchronization signal, a clock signal, and image data Data of certain bits via an interface circuit by using a low voltage differential signaling (LVDS) transmitter of a graphics controller. The vertical and horizontal synchronization signals and clock signal output from the system SYS are supplied to the timing controller TC. The image data Data sequentially output from the system SYS are also supplied to the timing controller TC.

The timing controller TC receives the horizontal synchronization signal, the vertical synchronization signal, a data enable signal, the clock signal, and the image data Data from an interface. The vertical synchronization signal indicates a time required to display one frame. The horizontal synchronization signal indicates a time required to display one horizontal line, i.e., one row of pixels. Therefore, the horizontal synchronization signal includes the number of pulses corresponding to the number of pixels included in one row. The data enable signal indicates a period in which valid image data is located. In addition, the timing controller TC re-arranges the image data Data received via the interface in such a manner that the image data Data may be supplied to the data driver DD. A control signal generator receives the horizontal synchronization signal, the vertical synchronization signal, the data enable, and the clock signal from the interface, and generates and supplies a data control signal DCS, an output control signal OCS, and a gate control signal GCS respectively to the data driver DD, the output controller OC, and the gate driver GD.

The data control signal DCS supplied to the data driver DD includes a source sampling clock signal SSC, a source output enable signal SOE, a source start pulse signal SSP, a polarity reverse signal POL, etc. The source sampling clock signal SSC is used as a sampling clock for latching the image data Data in the data driver DD, and determines a driving frequency of the data driver DD. The source output enable signal SOE is involved in transmitting the image data Data latched due to the source sampling clock signal SSC, to the display unit DSP. The source start pulse signal SSP is a signal indicating a start point for latching or sampling the image data Data in one horizontal period. The polarity reverse signal POL is a signal indicating the polarity of a data voltage to be supplied to the pixels PX, for inversion driving of the display device.

The data driver DD converts the received image data Data into analog data voltages by using a preset grayscale voltage in response to the data control signal DCS input from the timing controller TC, and supplies the data voltages to first to ith data output terminals DO1 to DOi. In this case, the data driver DD outputs the data voltages to the first to ith data output terminals DO1 to DOi in response to the source output enable signal SOE provided from the timing controller TC. That is, the data driver DD simultaneously latches i bits of the image data Data in accordance with a rising edge of the source output enable signal SOE, converts the latched i bits of the image data Data into analog data voltages, and then simultaneously outputs the data voltages in accordance with a falling edge of the source output enable signal SOE.

The configuration of the data driver DD will now be described with reference to FIGS. 2 and 3.

Figure 2:
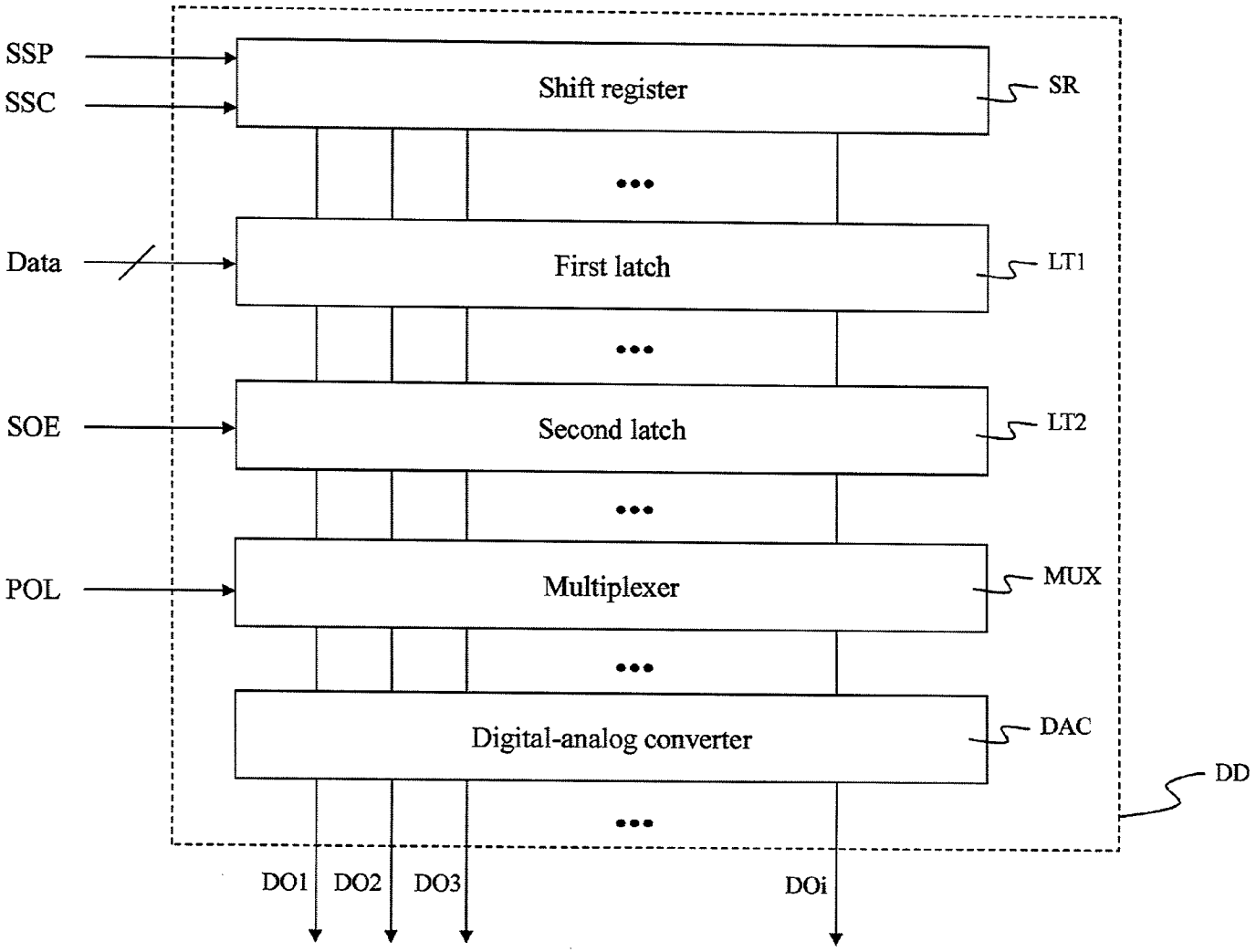
FIG. 2 illustrates the configuration of a data driver of FIG. 1.
Figure 3:
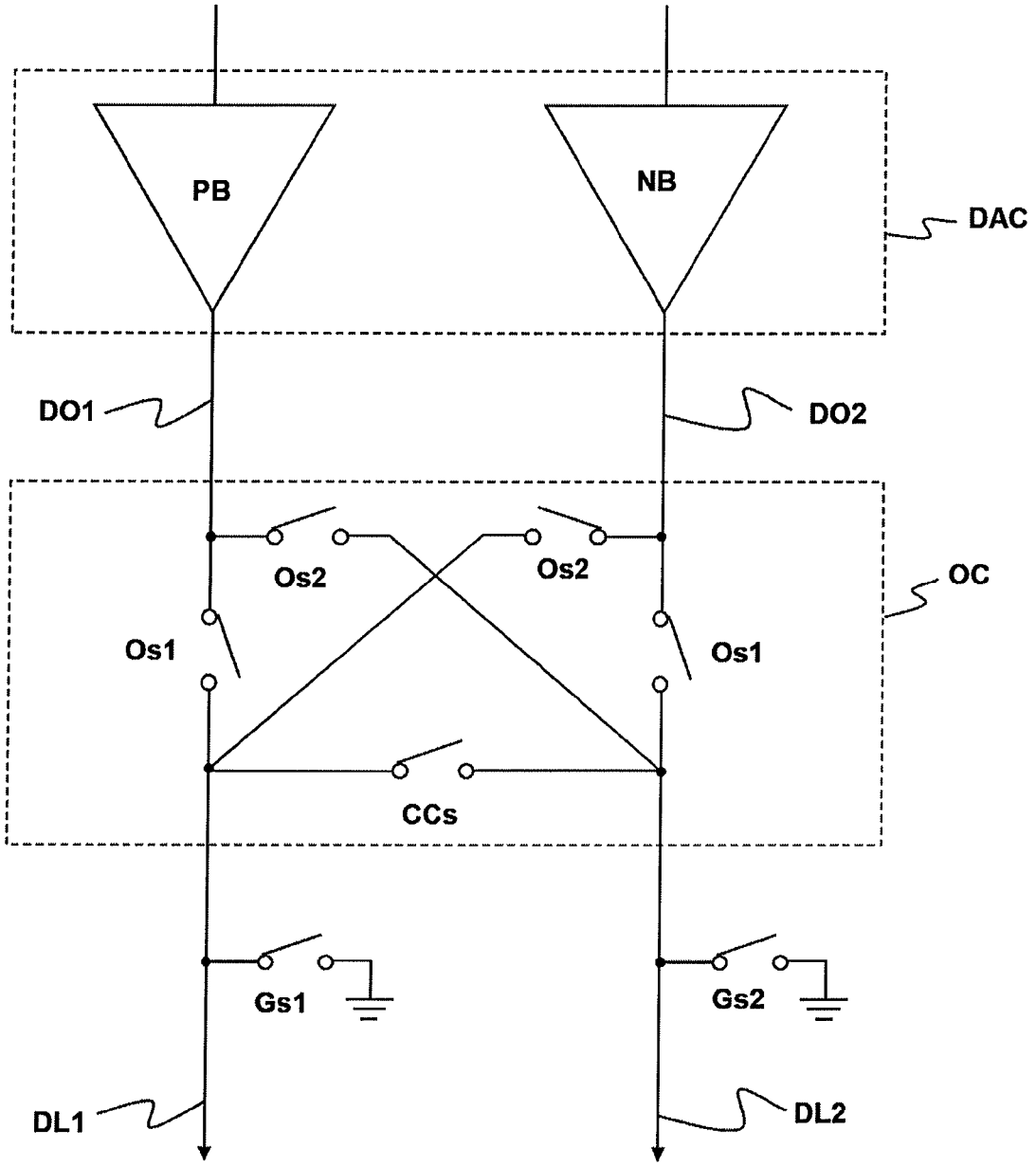
FIG. 3 illustrates the configuration of a digital-analog converter of FIG. 2 and an output controller of FIG. 1.

FIG. 2 illustrates the configuration of the data driver DD of FIG. 1, and FIG. 3 illustrates the configuration of a digital-analog converter DAC of FIG. 2 and the output controller OC of FIG. 1.

As illustrated in FIG. 2, the data driver DD includes a shift register SR, a first latch LT1, a second latch LT2, a multiplexer MUX, and the digital-analog converter DAC.

The shift register SR sequentially generates sampling signals based on the source start pulse signal SSP and the source sampling clock signal SSC.

The first latch LT1 sequentially samples the image data Data of one horizontal line in accordance with the sampling signals provided from the shift register SR, and latches the sampled image data Data.

The second latch LT2 simultaneously latches the sampled image data Data provided from the first latch LT1 in accordance with a rising edge of the source output enable signal SOE, and simultaneously outputs the latched sampled image data Data in accordance with a falling edge of the source output enable signal SOE.

The multiplexer MUX simultaneously receives the sampled image data Data from the second latch LT2, and changes output locations of the sampled image data Data in accordance with the polarity reverse signal POL.

The digital-analog converter DAC converts the sampled image data Data provided from the multiplexer MUX, into analog data voltages. Since the digital-analog converter DAC includes a plurality of positive buffers PB and a plurality of negative buffers NB as illustrated in FIG. 3, the sampled image data Data input to the positive buffers PB are output as positive data voltages and the sampled image data Data input to the negative buffers NB are output as negative data voltages. The positive and negative data voltages are supplied via the first to ith data output terminals DO1 to DOi to the output controller OC. Only parts of the positive and negative buffers PB and NB are illustrated in FIG. 3.

The output control signal OCS supplied to the output controller OC includes switch control signals for controlling various switches formed in the output controller OC.

The output controller OC controls the data voltages provided from the data driver DD to be correctly applied to their corresponding data lines in accordance with the output control signal OCS. That is, in order to reverse the polarity of the image data Data, the data driver DD changes output locations of the image data Data in accordance with the above-described polarity reverse signal POL via the multiplexer MUX. The output controller OC re-changes the locations of the data voltages in such a manner that the data voltages are supplied to original corresponding data lines. In addition, the output controller OC interconnects data lines to which positive data voltages are applied and data lines to which negative data voltages are applied in a blank period of every frame and thus increases or reduces the voltages of the data lines to a common voltage level. As such, when a data voltage applied to each data line has opposite polarity to a previous frame, a charge speed of the data line may be improved.

As illustrated in FIG. 3, the output controller OC includes a plurality of first output control switches Os1, a plurality of second output control switches Os2, and a plurality of charge control switches CCs. Only parts of the first and second output control switches Os1 and Os2 and the charge control switches CCs are illustrated in FIG. 3.

The first output control switch Os1 is controlled in accordance with a first switch control signal provided from the timing controller TC, and is connected between the first data output terminal DO1 and the first data line DL1 which correspond to each other. For example, the first switch control signal may be in an active state when the polarity reverse signal POL is high in level may be in an inactive state when the polarity reverse signal POL is low in level. When the first switch control signal is in an active state, the first output control switch Os1 which receives the first switch control signal is turned on. Otherwise, when the first switch control signal is in an inactive state, the first output control switch Os1 which receives the first switch control signal is turned off.

The second output control switch Os2 is controlled in accordance with a second switch control signal provided from the timing controller TC, and is connected between the first data output terminal DO1 and the second data line DL2 corresponding to the second data output terminal DO2 disposed adjacent to the first data output terminal DO1. For example, the second switch control signal may be in an inactive state when the polarity reverse signal POL is high in level and may be in an active state when the polarity reverse signal POL is low in level. When the second switch control signal is in an active state, the second output control switch Os2 which receives the second switch control signal is turned on. Otherwise, when the second switch control signal is in an inactive state, the second output control switch Os2 which receives the second switch control signal is turned off.

If any sampled image data Data output from the multiplexer MUX of the data driver DD corresponds to the first data line DL1 and is output via the positive buffer PB, the first output control switch Os1 is turned on while the second output control switch Os2 is turned off. Therefore, the above-described sampled image data Data corresponding to the first data line DL1 is applied to the first data line DL1. Otherwise, if any sampled image data Data output from the multiplexer MUX of the data driver DD corresponds to the second data line DL2 and is changed in its output location to be input to the positive buffer PB corresponding to the first data line DL1, the first output control switch Os1 is turned off while the second output control switch Os2 is turned on. Therefore, the above-described sampled image data Data corresponding to the second data line DL2 is correctly applied to the second data line DL2.

The charge control switch CCs is controlled in accordance with a third switch control signal provided from the timing controller TC, and is connected between the first and second data lines DL1 and DL2 disposed adjacent to each other. The charge control switch CCs is turned on only in a blank period of every frame, and is continuously turned off in periods other than the blank period.

The gate control signal GCS supplied to the gate driver GD includes a gate start pulse signal GSP, a gate shift clock signal GSC, a gate output enable signal GOE, etc. The gate start pulse signal GSP controls a timing of the first gate signal of the gate driver GD, the gate shift clock signal GSC is a signal for sequentially shifting the gate start pulse signal GSP, and the gate output enable signal GOE controls an output timing of the gate driver GD.

The gate driver GD controls on/off states of thin film transistors of the pixels PX in response to the gate control signal GCS input from the timing controller TC, and controls the data voltages supplied from the data driver DD to be applied to pixel electrodes connected to the thin film transistors. To this end, the gate driver GD sequentially outputs and supplies the first to jth gate signals to the first to jth gate lines GL1 to GLj. Whenever one gate line is driven, data voltages to be applied to the red, green, and blue pixels R, G, B of one horizontal line are supplied to the first to ith data output terminals DO1 to DOi.

The first to ith garbage switches Gs1 to Gsi are respectively connected to the first to ith data lines DL1 to DLi. The first to ith garbage switches Gs1 to Gsi connect the first to ith data lines DL1 to DLi to a ground terminal at a timing when a power supply voltage is applied to the display device (hereinafter referred to as a power input timing). The first to ith garbage switches Gs1 to Gsi discharge the voltages of the entire first to ith data lines DL1 to DLi before the display device operates normally, and thus prevent an abnormal image from appearing on the display unit DSP before the normal driving period. The first to ith garbage switches Gs1 to Gsi are all turned off not to influence the voltages of the first to ith data lines DL1 to DLi in the normal driving period. In particular, according to the present invention, the first to ith garbage switches Gs1 to Gsi are turned off later than an output timing of a first source output enable signal SOE generated after the above-described power input timing. In other words, the first to ith garbage switches Gs1 to Gsi cut the connection between the first to ith data lines DL1 to DLi and the ground terminal at a timing later than the output timing of the source output enable signal SOE first provided from the timing controller TC.

In a part of a period when the first to ith garbage switches Gs1 to Gsi are all connected to the ground terminal, the output controller OC controls internal switches thereof in such a manner that the first to ith data output terminals DO1 to DOi of the data driver DD are all connected to the first to ith data lines DL1 to DLi.

As described above, in the present invention, since the first to ith garbage switches Gs1 to Gsi are turned off at a timing later than the output timing of the first source output enable signal SOE, unknown data generated in the data driver DD at the power input timing may be prevented from being applied to the first to ith data lines DL1 to DLi. In other words, since the first to ith garbage switches Gs1 to Gsi are turned on for a sufficiently long period including a period for outputting unknown data voltages from the data driver DD, the unknown data voltages may be completely discharged to a ground level. Therefore, the first to ith data lines DL1 to DLi may be stabilized to the ground level while the unknown data voltages are output.

The first to ith garbage switches Gs1 to Gsi may be controlled as described below.

Figure 4:
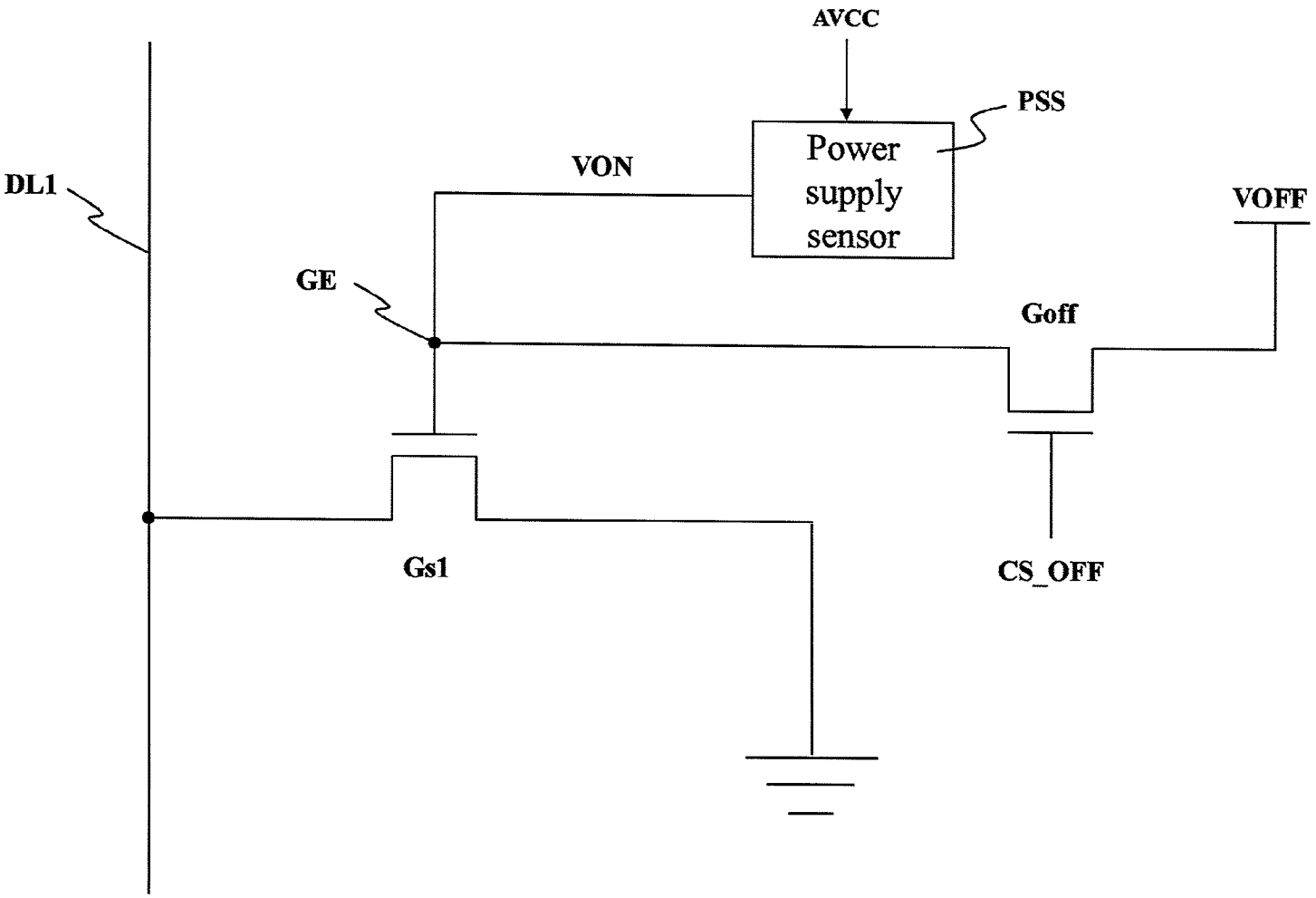
FIG. 4 is a view for describing a process of controlling garbage switches.

FIG. 4 is a view for describing a process of controlling the first to ith garbage switches Gs1 to Gsi.

As illustrated in FIG. 4, the display device according to the embodiment of the present invention further includes a power supply sensor PSS and an OFF control switch Goff.

The power supply sensor PSS senses whether a power supply voltage AVCC is applied to the display device. If it is sensed that the power supply voltage AVCC is input, the power supply sensor PSS generates and applies an ON voltage VON to the first to ith garbage switches Gs1 to Gsi. The first to ith garbage switches Gs1 to Gsi are turned on in accordance with the ON voltage VON. As an example, FIG. 4 illustrates that the ON voltage VON is supplied to the first garbage switch Gs1 connected to the first data line DL1.

The power supply sensor PSS may compare the magnitude of the power supply voltage AVCC with that of a preset reference voltage and may output the ON voltage VON only until the magnitude of the power supply voltage AVCC becomes equal to that of the preset reference voltage. Alternatively, the power supply sensor PSS may interrupt output of the ON voltage VON in accordance with the above-described first source output enable signal SOE. That is, output of the ON voltage VON may be interrupted in accordance with a rising edge of the first source output enable signal SOE.

However, since a gate electrode GE of the first garbage switch Gs1 is maintained in a floating state when output of the ON voltage VON from the power supply sensor PSS is interrupted, even when output of the ON voltage VON is interrupted, the ON voltage VON applied to the first garbage switch Gs1 remains at the gate electrode GE in a floating state. Therefore, the first garbage switch Gs1 is continuously turned on until another signal is applied to the gate electrode GE.

The OFF control switch Goff applies an OFF voltage VOFF to the first to ith garbage switches Gs1 to Gsi to turn off the first to ith garbage switches Gs1 to Gsi in accordance with an OFF control signal CS_OFF provided from outside the display device. As an example, FIG. 4 illustrates that the OFF voltage VOFF is supplied to the first garbage switch Gs1 connected to the first data line DL1.

Here, the OFF control signal CS_OFF is supplied to the OFF control switch Goff at a timing later than the output timing of the first source output enable signal SOE provided from the timing controller TC after the above-described power input timing. In detail, the OFF control signal CS_OFF may be applied to a gate electrode of the OFF control switch Goff at a timing later than a rising edge of the first source output enable signal SOE.

The OFF control signal CS OFF may be replaced by the above-described gate control signal GCS. That is, the OFF control signal CS_OFF may be replaced by one of the gate start pulse signal GSP, the gate shift clock signal GSC, and the gate output enable signal GOE. For example, the gate start pulse signal GSP may be supplied to the OFF control switch Goff at a timing later than the output timing of the first source output enable signal SOE. In this case, since an output timing of the gate start pulse signal GSP is changed, output timings of the gate shift clock signal GSC and the gate output enable signal GOE are correspondingly changed. As described above, if an output timing of the gate control signal GCS is changed, an output timing of the gate driver GD which receives the gate control signal GCS is also changed.

The above-described power supply sensor PSS may receive, instead of the power supply voltage AVCC, a logic voltage generated based on the power supply voltage AVCC. In other words, the power supply sensor PSS may generate the ON voltage VON upon sensing that the logic voltage is input.

Figure 5:
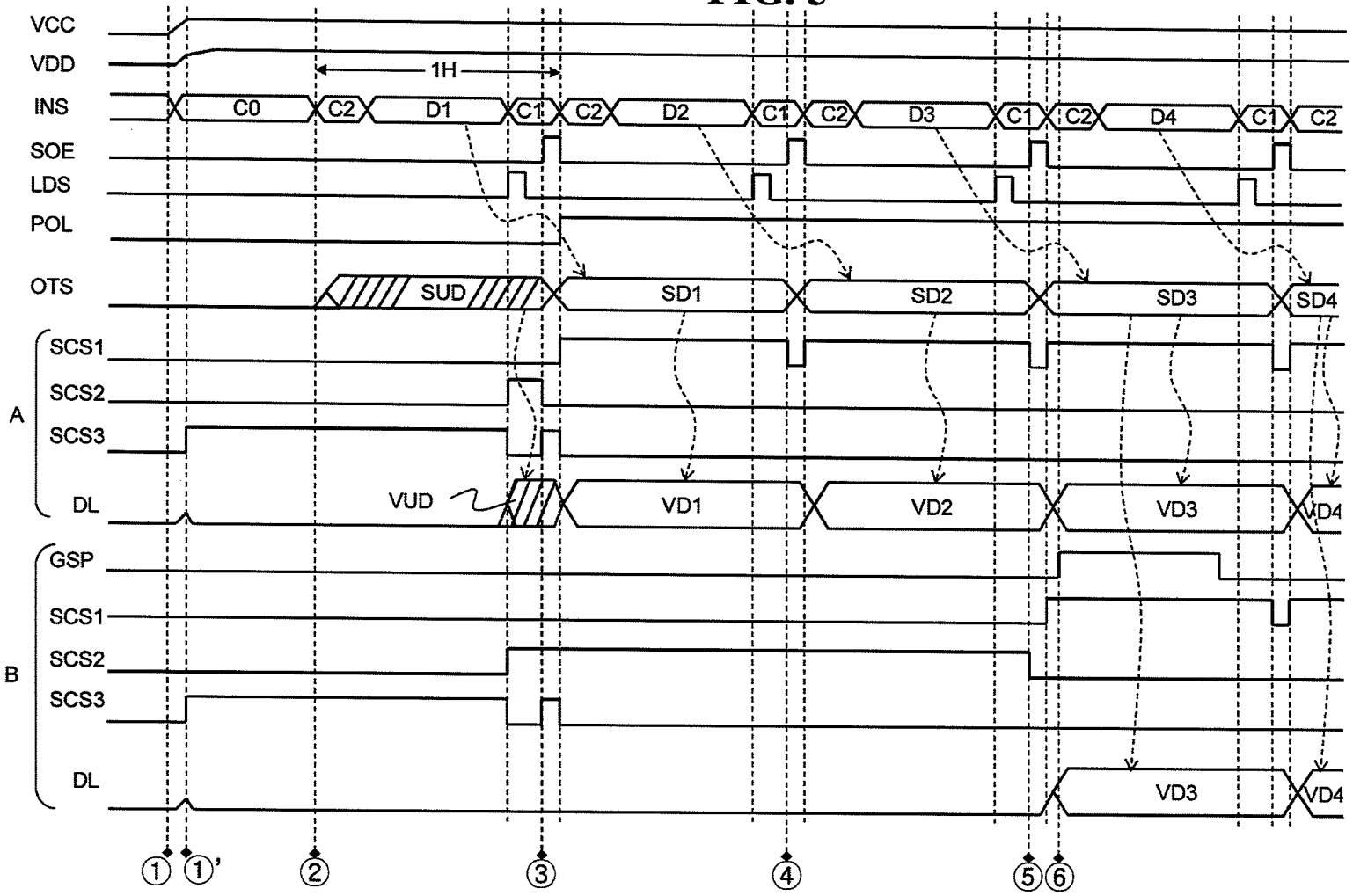
FIGS. 5 and 6 are views for describing the effect of the present invention compared to the related art.
Figure 6:
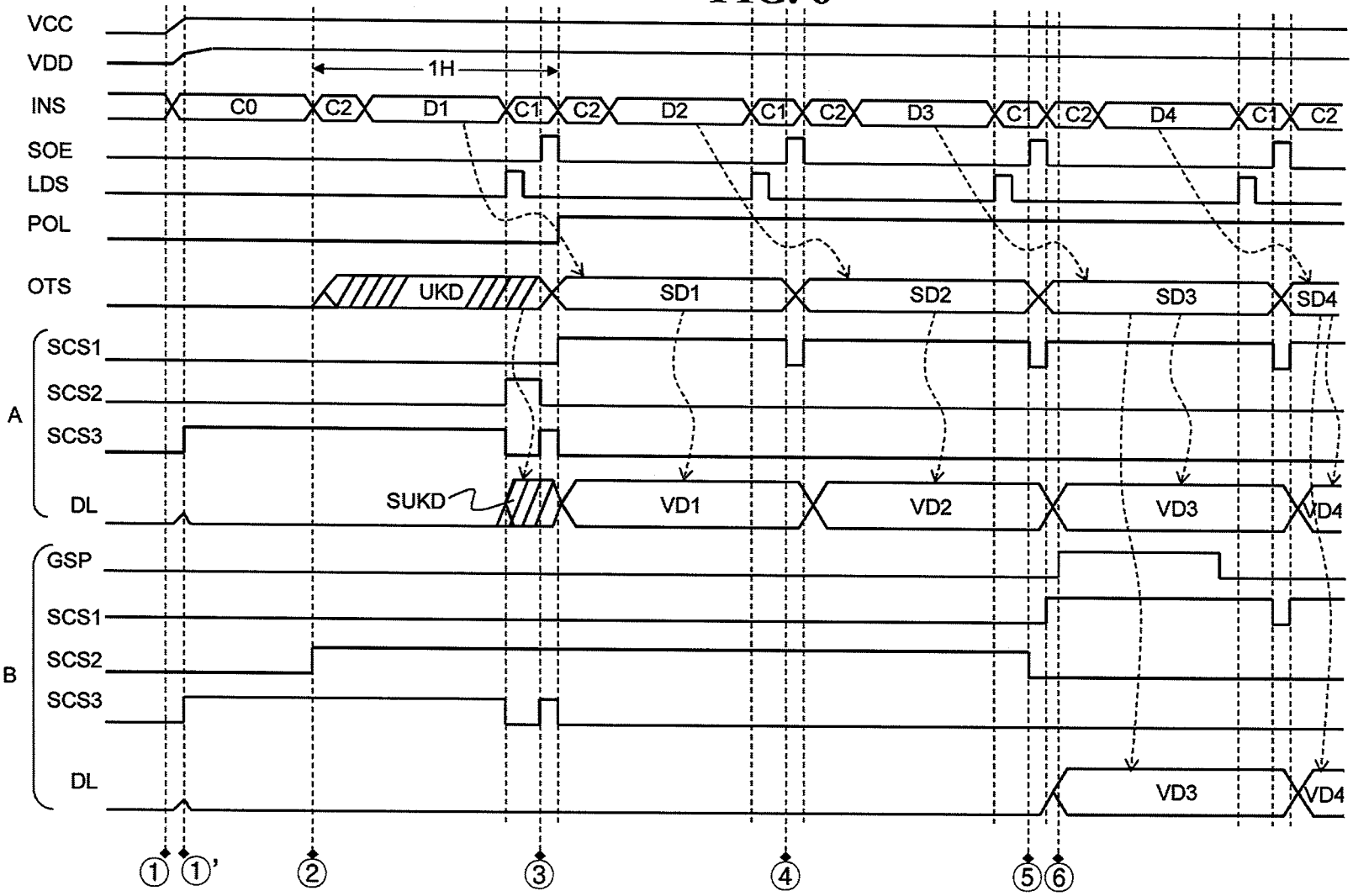

FIGS. 5 and 6 are views for describing the effect of the present invention compared to the related art.

Input signals INS provided from the timing controller TC are input to the data driver DD at a power input timing ①. The input signals INS include various control signals and image data.

At timing ②, normal image data (D1 to D4) and various control signals (C1 and C2) start to be input to the data driver DD. From timing ②, the control signals and the image data of one horizontal line are input to the data driver DD in every horizontal period 1H. The image data of each horizontal period 1H have a grayscale corresponding to black. The control signals input to the data driver DD in the horizontal period 1H include the above-described data control signal DCS. In particular, control signal C1 of each horizontal period 1H includes a latch end signal LDS and the source output enable signal SOE. Here, the latch end signal LDS is a signal informing that the image data of one horizontal line are completely latched in the first latch LT1. If the latch end signal LDS is generated, the source output enable signal SOE is subsequently generated. The image data of each horizontal period 1H are applied to a data line DL after the horizontal period 1H. For example, first image data D1 in a first horizontal period (the image data of one horizontal line) are applied to the data line DL in a second horizontal period in accordance with the first source output enable signal SOE. This is because the image data of one horizontal line input to the data driver DD are output to the data line DL after being latched for one horizontal period 1H.

A period between timing ① and timing ② is a clock training period for synchronization between the timing controller TC and the data driver DD. Control signal C0 input from the timing controller TC to the data driver DD in this period may include clock signals for synchronization.

The first source output enable signal SOE is output at timing ③. A second source output enable signal SOE is output at timing ④ and a third source output enable signal SOE is output at timing ⑤.

In FIG. 5, first to third switch control signals SCS1 to SCS3 and the data line DL collectively marked as 'A' denote signals applied to a display device according to the prior art and a data line voltage state thereof, and the first to third switch control signals SCS1 to SCS3, the gate start pulse signal GSP, and the data line DL collectively marked as 'B' denote signals applied to a display device according to the present invention and a data line voltage state thereof.

Reference character OTS denotes output of the second latch LT2 included in the data driver DD. That is, reference character SDn (n being a natural number) denotes sampled image data of image data Dn of an nth horizontal line. In addition, reference characters SUD denote unknown data (unknown sampled data).

Reference characters VDn denote data voltages regarding the sampled image data SDn of the nth horizontal line. In addition, reference characters VUD denote an unknown data voltage regarding the unknown data SUD.

As illustrated in A of FIG. 5, since prior art garbage switches are turned off due to the first source output enable signal SOE generated at timing ①, the unknown data voltage VUD is applied to the data line DL. That is, the unknown data voltage VUD applied to the data line DL may not be completely discharged to the ground level. As such, if the unknown data voltage VUD is quite high, overcurrent may flow into the data driver DD, causing malfunction of the data driver DD. In this case, data voltages VD1 to VD4 applied after the unknown data voltage VUD may be output as abnormal values to display an abnormal image.

However, since the first to ith garbage switches Gs1 to Gsi according to the present invention are turned off due to, instead of the first source output enable signal SOE, the gate start pulse signal GSP output later than the first source output enable signal SOE, eventually, the first to ith garbage switches Gs1 to Gsi is turned on for a sufficiently long time compared to the prior art garbage switches. As such, the unknown data voltage VUD thereof may be completely discharged to the ground level within a sufficient time. Therefore, malfunction of the data driver DD may be prevented.

As illustrated in B of FIG. 5, since the gate start pulse signal GSP is output after timing ⑤, the output timing of the third source output enable signal SOE, eventually, the first to ith garbage switches Gs1 to Gsi are continuously turned on for a long time from timing ① to timing ⑥. In addition, as illustrated in FIG. 5, the second switch control signal SCS2 is in an active state from an output timing of a first latch end signal LDS to timing ⑤, the output timing of the third source output enable signal SOE. Therefore, according to the present invention, in a period when the first to ith garbage switches Gs1 to Gsi and the second output control switches Os2 are all turned on, the unknown data voltage VUD may be discharged to the ground level.

As illustrated in B of FIG. 6, the second switch control signal SCS2 is in an active state from timing ② when the unknown data SUD starts to be applied to the data line DL to timing ⑤, the output timing of the third source output enable signal SOE. Therefore, according to the present invention, in a period when the first to ith garbage switches Gs1 to Gsi and the second output control switches Os2 are all turned on, the unknown data voltage VUD may be discharged to the ground level.

According to the present invention, the first to ith garbage switches Gs1 to Gsi may be turned on from timing ①' when a logic voltage VCC is input to a data driver DD.

Further, according to the present invention, the first to ith garbage switches Gs1 to Gsi may be turned on at timing ④, the output timing of the second source output enable signal SOE, or timing ⑤, the output timing of the third source output enable signal SOE. To this end, the gate start pulse signal GSP may be output at timing ④ or timing ⑤.

In B of FIGS. 5 and 6, instead of the first switch control signal SCS1, the second switch control signal SCS2 may be in an active state in the above-described period.

In the present invention, the ground level may be set as a common voltage level instead of a ground voltage level. For example, if the display device according to the present invention is a twisted nematic (TN) liquid crystal display device, garbage switches may be connected to a ground terminal. Otherwise, if the display device is an in-plane switching (IPS) liquid crystal display device, the garbage switches may be connected to a common electrode to which a common voltage is applied.

The display device according to the present invention has the following effect.

Garbage switches are continuously turned on until a timing later than an output timing of a first source output enable signal. Therefore, an unknown data voltage may be completely discharged to a ground level. Therefore, malfunction of a data driver due to overcurrent may be prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a data driver having i data output terminals (i being a natural number greater than 1), the data driver outputting data voltages to the i data output terminals in accordance with a source output enable signal provided from a timing controller;

an output controller connected between the i data output terminals and i data lines; and i garbage switches respectively connected to the i data lines and that connects the i data lines to a ground terminal at a power input timing when a power supply voltage is applied to the display device, and that interrupts the connection between the i data lines and the ground terminal at a timing later than an output timing of a first source output enable signal provided from the timing controller after the power input timing, wherein the output controller comprises:

a first output control switch controlled in accordance with a first switch control signal provided from the timing controller, and connected between a data output terminal and a data line which correspond to each other;

a second output control switch controlled in accordance with a second switch control signal provided from the timing controller, and connected between a data output terminal and a data line corresponding to another data output terminal disposed adjacent to the data output terminal; and a charge share switch controlled in accordance with a third switch control signal provided from the timing controller, and connected between data lines disposed adjacent to each other, and wherein one of the first and second output control switches is turned on in a part of a period when the i garbage switches are connected to the ground terminal.

2. The display device according to claim 1, further comprising a power supply sensor that senses whether the power supply voltage is applied to the display device and applying an ON voltage to the i garbage switches to turn on the i garbage switches.

3. The display device according to claim 2, wherein the power supply sensor compares a magnitude of the power supply voltage with that of a preset reference voltage and outputs the ON voltage only until the magnitude of the power supply voltage becomes equal to that of the preset reference voltage.

4. The display device according to claim 2, wherein the power supply sensor interrupts output of the ON voltage in accordance with the first source output enable signal.

5. The display device according to claim 1, further comprising an OFF control switch that applies an OFF voltage to the i garbage switches to turn off the i garbage switches in accordance with an OFF control signal provided from outside the display device, wherein the OFF control signal is supplied to the OFF control switch at a timing later than the output timing of the first source output enable signal provided from the timing controller after the power input timing.

6. The display device according to claim 5, further comprising a gate driver that supplies a gate signal to pixels connected to the i data lines, wherein the OFF control signal is a gate control signal for controlling the gate driver.

7. The display device according to claim 6, wherein the gate control signal comprises a gate start pulse signal that controls a timing of a first gate signal of the gate driver, a gate shift clock signal that shifts the gate start pulse signal, and a gate output enable signal that controls an output timing of the gate driver, and wherein the OFF control signal is one of the gate start pulse signal, the gate shift clock signal, and the gate output enable signal.

* * * * *